US007735819B2

(12) United States Patent
Lin

(10) Patent No.: US 7,735,819 B2
(45) Date of Patent: Jun. 15, 2010

(54) AUTOMATIC PAPER FEED APPARATUS HAVING IMPROVED PAPER SEPARATION DEVICE

(75) Inventor: Hsien-chi Lin, Tantz Shiang (TW)

(73) Assignee: Asia Optical Co., Inc, Taichung (TW)

( * ) Notice: Subject to any disclaimer, the term of this patent is extended or adjusted under 35 U.S.C. 154(b) by 457 days.

(21) Appl. No.: 11/743,463

(22) Filed: May 2, 2007

(65) Prior Publication Data

US 2007/0278733 A1 Dec. 6, 2007

(30) Foreign Application Priority Data

Jun. 2, 2006 (TW) ..... 95119690 A

(51) Int. Cl.
*B65H 5/00* (2006.01)

(52) U.S. Cl. ..... 271/10.11

(58) Field of Classification Search ..... 271/121, 271/122, 124, 125, 117, 10.01, 10.11; 74/413, 74/414

See application file for complete search history.

(56) References Cited

U.S. PATENT DOCUMENTS 5,085,420 A * 2/1992 Sata ..... 271/114
5,860,645 A * 1/1999 Tomura et al. ..... 271/10.13
7,441,763 B2 * 10/2008 Su ..... 271/10.11
2004/0070136 A1 * 4/2004 Chung ..... 271/117
2004/0155397 A1 * 8/2004 Gaarder et al. ..... 271/10.11
2006/0038338 A1 * 2/2006 Lin ..... 271/10.04

FOREIGN PATENT DOCUMENTS

JP 3-284556 * 12/1991
TW 258086 9/1995

* cited by examiner

*Primary Examiner*—Patrick Mackey
*Assistant Examiner*—Thomas A Morrison

(57) ABSTRACT

An automatic paper feed apparatus includes a paper pickup roller (21), a paper feed roller (31) and a paper separation device (10). The paper separation device is a compound gear consisting of a first paper separation gear (11) and a second paper separation gear (12). The first and second paper separation gears are rotatably and mutually drivably coupled with each other by the engagement between a projection (13) and a protrusion (14) respectively formed thereon. The paper pickup roller and the paper feed roller are respectively actuated to rotate by the second and first paper separation gears through a paper pickup gear mechanism (23) and a paper feed gear mechanism (33, 34) each mounted on a same shaft and engaged therebetween. At the initial stage, the first paper separation gear drives the second paper separation gear to rotate, and thus the paper pickup roller and the paper feed roller are respectively actuated to rotate by the second and first paper separation gears. By then making the linear velocity of the paper feed roller to be higher than that of the paper pickup roller, a predetermined angular clearance is formed between the projection and protrusion of the respective first and second paper seperation gears, so that successive paper sheets are separated from each other, one by one, by a predetermined interval.

7 Claims, 3 Drawing Sheets

AUTOMATIC PAPER FEED APPARATUS HAVING IMPROVED PAPER SEPARATION DEVICE

BACKGROUND OF THE INVENTION

1. Field of the Invention

The present invention relates to an automatic paper feed apparatus, and particularly to an automatic paper feed apparatus having an improved paper separation device.

2. Description of Prior Art

An automatic paper feed apparatus generally includes a paper pickup roller for picking up one by one the paper sheets stored in a paper cassette from the uppermost one, and a paper feed roller for feeding the picked-up sheet into the automatic paper feed apparatus. The main concern for the automatic paper feed apparatus is how to automatically and reliably separate paper sheets one by one. Various conventional paper separation technologies have been proposed, within which utilizing the linear velocity difference between the paper pickup roller and the paper feed roller to accomplish the paper separation purpose is a cheap and reliable one.

Taiwan Patent No. 258086 discloses an automatic paper separation device in two embodiments. In the first embodiment, a driving member is employed to drive a one-way clutch to rotate. At the beginning of picking up one paper sheet, the one-way clutch drives a clearance bushing to rotate, which sequentially drives a paper pickup roller to rotate for paper pickup. When the paper sheet is further led to and moved by a paper feed roller, because the surface velocity of the paper feed roller is higher than that of the paper pickup roller, velocity will be transferred to the paper pickup roller through the paper sheet. Therefore, the surface velocity of the paper pickup roller is changed to be equal to that of the paper feed roller, and the rotation velocity of the paper pickup roller is thus higher than that of the clearance bushing. After the paper pickup roller rotates a predetermined angle, the clearance bushing is driven by the paper pickup roller to rotate, whereby the rotation velocity of the clearance bushing is changed to be higher than that of the one-way clutch. Consequently, the clearance bushing disengages from the one-way clutch to be in a standby condition. When the paper sheet leaves the paper pickup roller, the paper pickup roller will stop rotating because loss of driving power from the paper feed roller. The clearance bushing is then driven by the one-way clutch again, and drives the paper pickup roller again to pickup another paper sheet after rotating a predetermined angle. The feeding interval between the two sheets of paper is determined by the rotation angle of the clearance bushing during the above time period. The second embodiment is substantially the same as the first embodiment described above, except that a flat helical spring replaces the one-way clutch in the first embodiment.

As described above, the above conventional automatic paper feed device accomplishes the paper separation purpose by adopting a driving member to drive a one-way clutch, the one-way clutch driving a clearance bushing, and the clearance bushing driving the paper pickup roller in turn. However, such a combination complicates the manufacturing, increases the cost, and also occupies a large transverse space in an automatic paper feed apparatus.

Accordingly, to overcome the disadvantages as described above, an improved paper separation device for an automatic paper feed apparatus is desired.

SUMMARY OF THE INVENTION

An object of the present invention is to provide an automatic paper feed apparatus having a paper separation device that is easy to manufacture and low in costs and has adequate precision.

To achieve the above object of the present invention, an automatic paper feed apparatus in accordance with the present invention includes a paper separation device, a paper pickup roller, a paper feed roller and a power source. The paper separation device is in the form of a compound gear consisting of a first paper separation gear and a second paper separation gear. The first and second paper separation gears are rotatably and mutually drivably coupled with each other by the engagement between a projection and a protrusion respectively formed thereon. The paper pickup roller is driven to rotate by the second paper separation gear through a paper pickup roller gear mounted on a same shaft. The paper feed roller is driven to rotate by the first paper separation gear through a paper feed roller gear mounted on a same shaft. The power source provides power to drive the first paper separation gear to rotate. The linear velocity of the paper feed roller is higher than that of the paper pickup roller, whereby a predetermined clearance is formed between the projection and protrusion of the respective first and second paper separation gears of the paper separation device.

In comparison with the prior art, the paper separation device of the present automatic paper feed apparatus takes the form of a compound gear only consisting of a first paper separation gear and a second paper separation gear. The first and second paper separation gears are rotatably and mutually drivably coupled with each other by the engagement between a projection and a protrusion respectively formed thereon. Due to the linear velocity difference between the paper feed roller and the paper pick-up roller, a clearance is formed between the first and second paper separation gears, whereby successive paper sheets are separated from each other, one by one, by a predetermined interval. By such a design, the present paper separation device has the advantages of easy manufacturing, low cost and adequate precision.

BRIEF DESCRIPTION OF THE DRAWINGS

The present invention may best be understood through the following description with reference to the accompanying drawings, in which.

DETAILED DESCRIPTION OF THE PREFERRED EMBODIMENT

To simplify description, the following detailed description of the present invention is only directed to the structures of a paper separation device, a paper pickup roller, a paper feed roller and a paper exit roller of an automatic paper feed apparatus constructed in accordance with the present invention and the relationship therebetween. Since the other constituent components of the automatic paper feed apparatus are substantially the same as those of the prior art and do not form an essential part of the inventive concept of the present invention, a detailed description thereof is thus omitted hereinafter.

Figure 1:
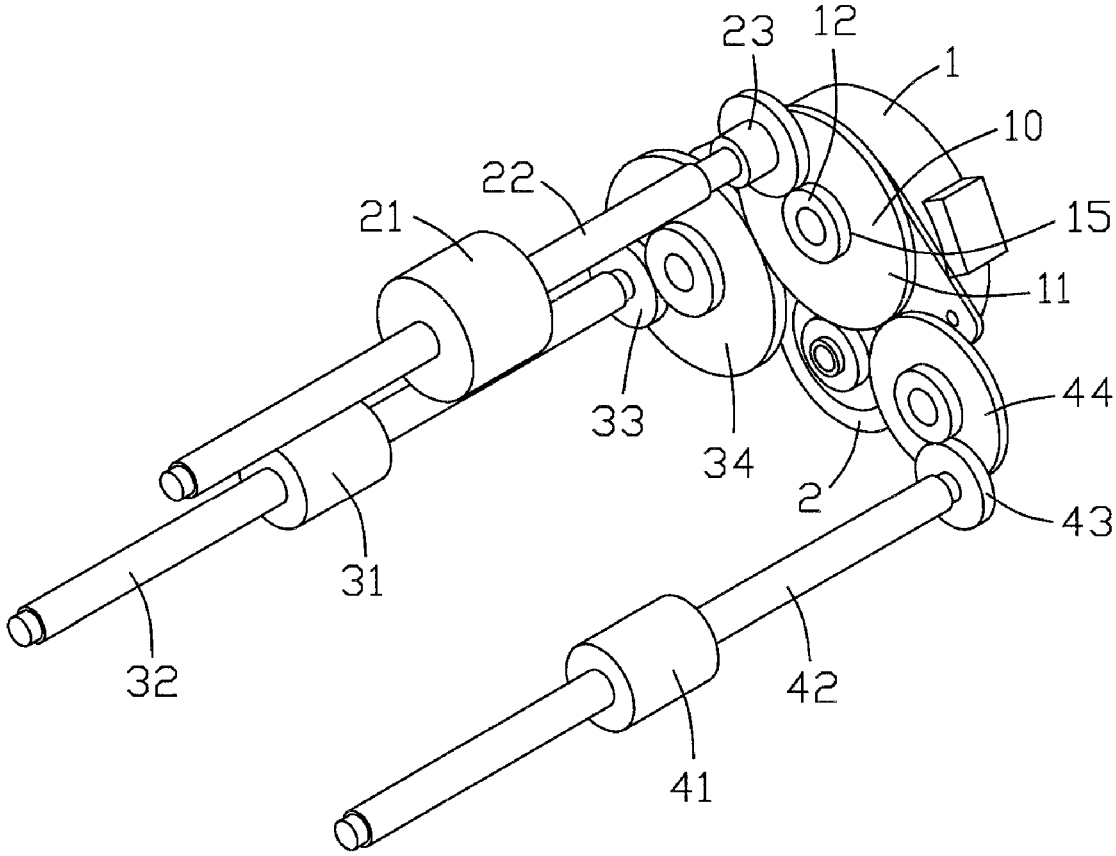
FIG. 1 is a perspective view illustrating major components of an automatic paper feed apparatus in accordance with the present invention.

Referring to FIG. 1, an automatic paper feed apparatus in accordance with the present invention includes a power source 1, a paper transmission device and a paper separation device 10.

The power source 1 is in the form of a motor. The motor 1 drives a motor gear (not shown), and the motor gear then drives a driven gear 2 for driving other components of the present automatic paper feed apparatus.

Figure 3:
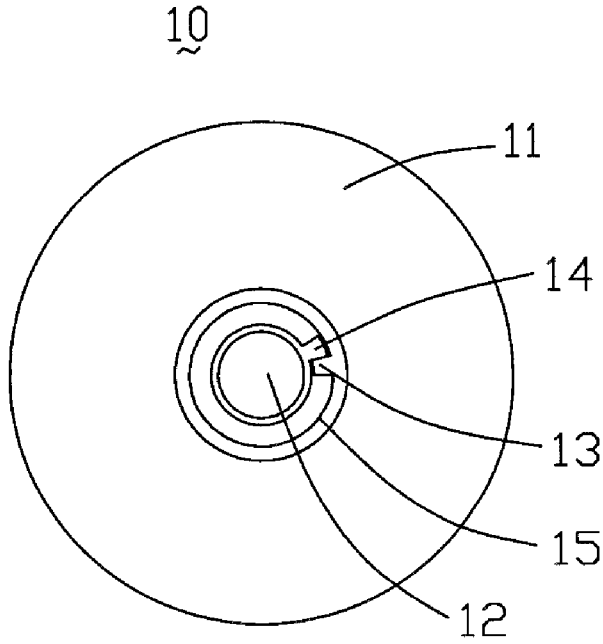
FIG. 3 is a schematic view illustrating the original positional relationship between a projection and a protrusion respectively formed on first and second paper separation gears of a paper separation device of the automatic paper feed apparatus in accordance with the present invention.

The paper separation device 10 is in the form of a compound gear consisting of a first paper separation gear 11 having a large outer diameter and a second paper separation gear 12 having a small outer diameter. The second paper separation gear 12 is coaxially and rotatably mounted in an axial hole 15 of the first paper separation gear 11. As shown in FIG. 3, a projection 13 is formed on or extends inwardly from the inner side of the axial hole 15 of the first paper separation gear 11, and correspondingly, a protrusion 14 is formed on or extends outwardly from the outer side of the second paper separation gear 12. During rotation, the projection 13 of the first paper separation gear 11 is engageable with the protrusion 14 of the second paper separation gear 12. Accordingly, the first paper separation gear 11 can be driven by the second paper separation gear 12 by engagement between the projection 13 and the protrusion 14, and vice verse. The first paper separation gear 11 of the paper separation device 10 is drivably engaged with the driven gear 2.

The paper transmission device includes a paper pickup roller 21 having a larger diameter, a paper feed roller 31 and a paper exit roller 41 respectively disposed on a paper pickup roller shaft 22, a paper feed roller shaft 32 and a paper exit roller shaft 42. A paper pickup roller gear 23 is mounted at one end of the paper pickup roller shaft 22, a paper feed roller gear 33 is mounted at one end of the paper feed roller shaft 32, and a paper exit roller gear 43 is mounted at one end of the paper exit roller shaft 42. The paper pickup roller gear 23 is engaged with the second paper separation gear 12 of the paper separation device 10. A paper feed compound gear 34 is engaged between the paper feed roller gear 33 and the first paper separation gear 11 of the paper separation device 10. A paper exit compound gear 44 is engaged between the paper exit roller gear 43 and the first paper separation gear 11 of the paper separation device 10.

Figure 2:
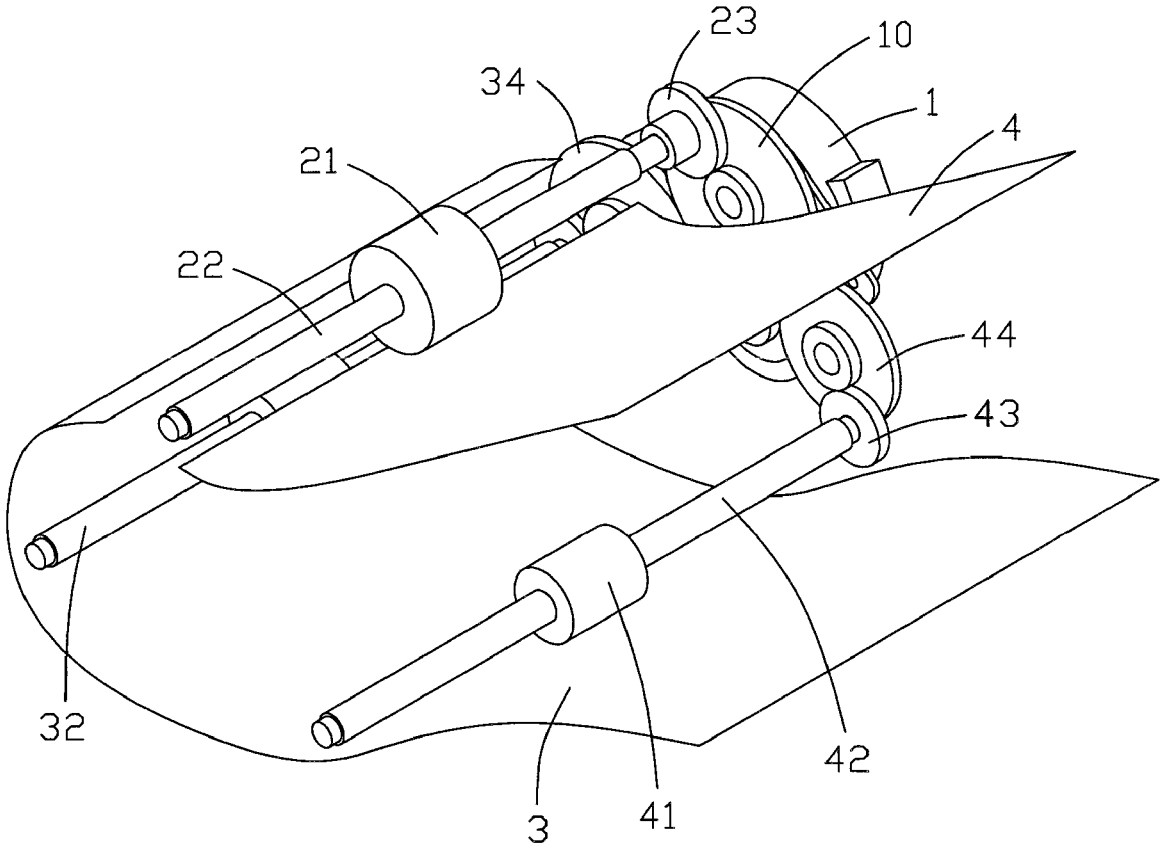
FIG. 2 is a schematic view illustrating a paper feeding process of the automatic paper feed apparatus in accordance with the present invention.

Also referring to FIG. 2, in operation, the motor 1 is first driven to drive the motor gear to rotate, and the motor gear in turn drives the engaged driven gear 2. The driven gear 2 then drives the engaged first paper separation gear 11 of the paper separation device 10 to rotate. Consequently, the second paper separation gear 12, the paper feed compound gear 34 and the paper exit compound gear 44, each of which is engaged with the first paper separation gear 11, are all urged by the first paper separation gear 11 to rotate for picking up a first paper sheet 3. At the beginning of picking up the paper sheet, the positional relationship between the projection 13 of the first paper separation gear 11 and the protrusion 14 of the second paper separation gear 12 is illustrated in FIG. 3. At this initial stage, the projection 13 of the first paper separation gear 11 drives the second paper separation gear 12 to rotate anticlockwise by abutment against the protrusion 14. Hence, the paper pickup roller 21 is actuated to rotate by the paper pickup roller gear 23 that is engaged with the second paper separation gear 12, whereby the first paper sheet 3 positioned uppermost begins to move due to a friction force between the first paper sheet 3 and the paper pickup roller 21.

Figure 4:
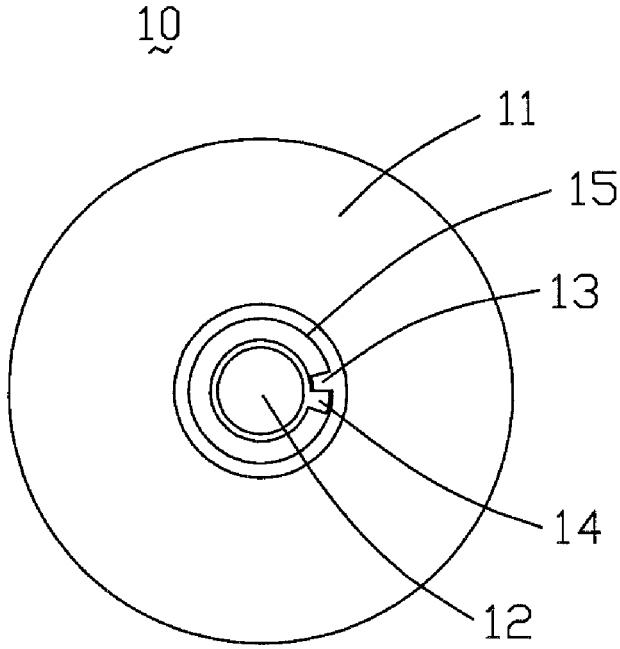
FIG. 4 is a schematic view illustrating a clearance formed between the projection and the protrusion as shown in FIG. 3 due to the velocity difference between a paper pickup roller and a paper feed roller of the present automatic paper feed apparatus.

After being picked up by the paper pickup roller 21, the first paper sheet 3 is further moved toward the paper feed roller 31. The paper feed roller 31 is actuated to rotate by the paper feed roller gear 33 that is driven by the first paper separation gear 11 through the paper feed compound gear 34 engaged therebetween. After the front edge of the paper sheet 3 touches the paper feed roller 31, due to the number of teeth of the paper feed compound gear 34, the rotation velocity Vf of the paper feed roller 31 is higher than the rotation velocity Vp of the paper pickup roller 21. Since the paper sheet 3 simultaneously contacts both the paper pickup roller 21 and the paper feed roller 31, the rotation velocity Vp of the paper pickup roller 21 is accelerated to be equal to that of the paper feed roller 31. Since the second paper separation gear 12 of the paper separation device 10 is engaged with the paper pickup roller gear 23, the accelerated paper pickup roller 21 thus actuates the second paper separation gear 12 of the paper separation device 10 to rotate at velocity Vf through the paper pickup roller gear 23 engaged therebetween. Accordingly, the rotation velocity of the second paper separation gear 12 is changed to be faster than that of the first paper separation gear 11. Thus, the protrusion 14 of the second paper separation gear 12 disengages from the projection 13 of the first paper separation gear 11, and rotates at a predetermined angle to a final position as shown in FIG. 4. In this position of FIG. 4, the clearance between the projection 13 and the protrusion 14 of the respective first and second paper separation gears 11, 12 is defined by $((Vf-Vp)/Vp)*L$, where L represents paper length. After the paper sheet 3 leaves the paper pickup roller 21, since no driving force from the paper sheet is further provided and since a clearance is formed between the projection 13 and the protrusion 14 of the respective first and second paper separation gears 11, 12, the second paper separation gear 12 stops rotating. Meanwhile, the first paper separation gear 11 continues rotating under the driving force of the driven gear 2 until the projection 13 thereof is brought into contact with the protrusion 14 of the second paper separation gear 12 for a second time for driving the second paper separation gear 12 to rotate again. The paper pickup roller 21 is then further driven by the second paper separation gear 12 through the paper pickup roller gear 23 for picking up a second paper sheet 4. Subsequently, the above-described operations are repeated for feeding the paper sheets one by one.

As described above, the paper separation device 10 of the present automatic paper feed apparatus is in the form of a compound gear consisting of a first paper separation gear 11 and a second paper separation gear 12. The first and second paper separation gears 11, 12 are rotatably and mutually drivably coupled with each other by the engagement between a projection and a protrusion respectively formed thereon. Due to the linear velocity difference between the paper feed roller 31 and the paper pickup roller 21, a clearance is formed between the first paper separation gear 11 and the second paper separation gear 12, whereby successive paper sheets are separated from each other, one by one, by a predetermined interval. By such a design, the present paper separation device 10 has the advantages of easy manufacturing, low cost and adequate precision.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An automatic paper feed apparatus, comprising:

a paper separation device consisting of a compound gear, the compound gear being composed of a first paper separation gear and a second paper separation gear respectively having a projection and a protrusion formed thereon, the first and second paper separation gears being rotatably and mutually drivably coupled with each other by the engagement between the projection and the protrusion;

a paper pickup roller that is driven to rotate by the second paper separation gear of the paper separation device through a paper pickup gear mechanism, the paper pickup gear mechanism being disposed between the paper pickup roller and the second paper separation gear and being directly meshed with the second paper separation gear;

a paper feed roller that is driven to rotate by the first paper separation gear of the paper separation device through a paper feed gear mechanism, the paper feed gear mechanism consisting of a paper feed roller gear mounted on a same shaft as the paper feed roller and a paper feed compound gear offsetly disposed between and directly meshed with the paper feed roller gear and the first paper separation gear; and a power source providing power to drive the first paper separation gear of the paper separation device to rotate;

wherein, the paper feed roller has a linear velocity higher than a linear velocity of the paper pickup roller and a predetermined clearance is thus formed between the projection and protrusion of the respective first and second paper separation gears of the paper separation device.

2. The automatic paper feed apparatus as claimed in claim 1, wherein the first paper separation gear defines an axial hole and the second paper separation gear is rotatably mounted in the axial hole of the first paper separation gear.

3. The automatic paper feed apparatus as claimed in claim 2, wherein the projection inwardly extends from an inner side of the axial hole of the first paper separation gear.

4. The automatic paper feed apparatus as claimed in claim 3, wherein the protrusion outwardly extends from an outer side of the second paper separation gear.

5. The automatic paper feed apparatus as claimed in claim 1 further comprising a paper exit roller, the paper exit roller being driven to rotate by the first paper separation gear of the paper separation device through a paper exit gear mechanism, the paper exit gear mechanism being disposed between the paper exit roller and the first paper separation gear and being directly meshed with the first paper separation gear.

6. The automatic paper feed apparatus as claimed in claim 1, wherein the clearance between the projection and the protrusion of the respective first and second paper separation gears is defined by $((V_f-V_p)/V_p)*L$, where $V_f$ represents the linear velocity of the paper feed roller, $V_p$ represents the linear velocity of the paper pickup roller, and L represents the paper length.

7. The automatic paper feed apparatus as claimed in claim 5, wherein the paper exit gear mechanism consists of a paper exit roller gear mounted on a same shaft as the paper exit roller and a paper exit compound gear offsetly disposed between and directly meshed with the paper exit roller gear and the first paper separation gear.

* * * * *